United States Patent [19]

Maehara

[11] Patent Number: 4,892,468

[45] Date of Patent: Jan. 9, 1990

[54] HYDRAULIC PUMP

[75] Inventor: Toshifumi Maehara, Hanazono, Japan

[73] Assignees: Akebono Brake Industry Co., Ltd.; Akebono Research, Development Centre Ltd., both of Tokyo, Japan

[21] Appl. No.: 229,457

[22] Filed: Aug. 8, 1988

[30] Foreign Application Priority Data

Aug. 24, 1987 [JP] Japan ..... 62-209955

[51] Int. Cl.[4] ..... F04B 17/00

[52] U.S. Cl. ..... 417/415; 417/511; 417/520; 417/559

[58] Field of Search ..... 417/511, 513, 514, 520, 417/415, 273, 271, 559

[56] References Cited

U.S. PATENT DOCUMENTS

| | | | |
|---|---|---|---|
| 1,526,343 | 2/1925 | Jouanneaux | 417/273 |
| 1,850,926 | 3/1932 | Feyens | 417/511 |
| 2,674,955 | 4/1954 | Hilton | 417/513 |
| 2,775,212 | 12/1956 | Hilton | 417/513 |
| 3,183,580 | 5/1965 | Raymond | 417/273 |
| 4,445,825 | 5/1984 | Budecker | 417/462 |
| 4,735,048 | 4/1988 | Gregory | 417/510 |

FOREIGN PATENT DOCUMENTS

| | | |
|---|---|---|
| 51-74203 | of 1976 | Japan . |
| 62-63185 | 3/1987 | Japan . |

*Primary Examiner*—Carlton R. Croyle
*Assistant Examiner*—Robert N. Blackmon
*Attorney, Agent, or Firm*—Oblon, Spivak, McClelland, Maier & Neustadt

[57] ABSTRACT

A hydraulic pump is disclosed, characterized in that, in the hydraulic pump including a cylinder body having a cylinder chamber, a suction port and an ejection port, a cam member and a reciprocatingly movable member are provided, wherein oil in said cylinder chamber is ejected when said movable member is pushed into said cylinder chamber by the cam member, a cylindrical piston is slidably fitted into said cylinder chamber, so that the movable member is engaged with the cylindrical piston when it is pushed into the cylinder chamber so shut off communication between the cylinder chamber and the suction port and a valve provided in the ejection passage communicating to said ejection port is opened due to the pressure rise when said movable member is further pushed into said cylinder chamber to eject the oil in the cylinder chamber outwardly.

8 Claims, 4 Drawing Sheets

HYDRAULIC PUMP

BACKGROUND OF THE INVENTION

FIELD OF THE INVENTION

The present invention relates to a hydraulic pump for the hydraulic circuit, in particular, to the hydraulic pump for the brake-control device used in the hydraulic brake circuit.

DISCUSSION OF THE BACKGROUND

Generally, as a hydraulic pump being a generating source of the pressure of hydraulic device used in the hydraulic circuit, the displacement pump with which the ejected quantity determined by the driving number of revolution of pump is constant regardless of the loading pressure has been used.

This displacement pump is roughly classified into the rotary pump type utilizing the engagement of gear or screw and the plunger pump type which sends out an equal quantity of oil to the volume of the movement of plunger or piston. Therebetween, the rotary pump, in particular, the gear pump is widely used for various construction vehicles etc. because of the structure being simple and the low price. The plunger pump is actively used for aircrafts, vehicles, etc. because it permits the generation of very high pressure, for example, a pressure as high as several score (Mega Pascals) and has an excellent performance in the number of revolutions over wide region ranging from low speed to high speed.

When the distributor is not used in the hydraulic circuit with such plunger pump, the control of the suction is usually made by the pump itself using the plunger pump of suction check valve type or of forced stroke type.

The suction check valve type has such a constitution, as shown in FIGS. 3(A) and (B), that a main spring (29) is provided between a cylinder body (7') and a plunger (25') so that one end of said plunger (25') protrudes from said cylinder body (7') to be always pressed against the outer circumferential face of a rotating eccentric cam(24), and, by the actions of said main spring (29) and said eccentric cam (24), the plunger (25') reciprocates in the cylinder body (7').

Moreover, a space is formed by the cylinder body (7') and the plunger (25') making a cylinder chamber (8) and, in the cylinder body (7'), a suction port (13) communicating said cylinder chamber (18) to a reservoir not shown is provided. Against said suction port (13), a suction ball (31) is pressed to be contacted closely by means of a suction spring (30) provided in the cylinder chamber (8). Thus, when the plunger (25') moves toward the side of eccentric cam (24) by the rotation of eccentric cam (24), the suction ball (31) moves due to the pressure difference between inside the cylinder chamber (8) and inside the reservoir to open the suction port (13) and to allow the oil to flow into the cylinder chamber (8) in the direction the arrow shown in FIG. 3(A). Also, in the cylinder body (7'), an ejection port (9) communcating the cylinder chamber (8) to an accumulator not shown in the diagram via an ejection passage (10) is further provided. Against said ejection port (9), an ejection ball (12) is pressed to be contacted closely by means of an ejection spring (11) provided on the side of the ejection passage (10). Thus, said ejection port (9) is closed at the time of said suction and, when the plunger (25') moves toward the side of cylinder chamber (8) by the rotation of eccentric cam (24), the ejection ball (12) moves outward due to the pressure difference between inside the cylinder chamber (8) and inside the ejection passage (10) to eject the oil in cylinder chamber (8) in the direction of arrow shown in FIG. 3(B). Besides, at the time of the ejection, the suction ball (31) is in a state closely contacted with the suction port (13), hence, the oil cannot return toward the side of reservoir.

Next, the plunger pump of forced stroke type has such a constitution, as shown in FIG. 4, that the oil, having flowed into a cylinder chamber (8) from outside a cylinder body (7') by raising of said piston (32) due to the top and bottom motion caused by an eccentric cam (24) positioned along the axis of rotation (2) of motor (1) is discharged through an ejection port (9) as the piston (32) descends. The pump of this type is characterized by having no suction check valve.

For these pumps, the distributor is unnecessary as described above, but, in the case of the pump of suction check valve type, a powerful spring becomes necessary to be used for the main spring due to the check pressure. For this reason, the capacity of motor the eccentric cam also becomes large in response thus leading to an uneconomic situation. Moreover, in the case of the pump of forced stroke type, the structure becomes complicated leading to inconvenience in handling.

SUMMARY OF THE INVENTION

The purpose of the invention is to provide a hydraulic pump with a simple structure, which necessitates neither a distributor nor suction check valve.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

The invention will be described in detail using the following embodiment.

Figure 1:
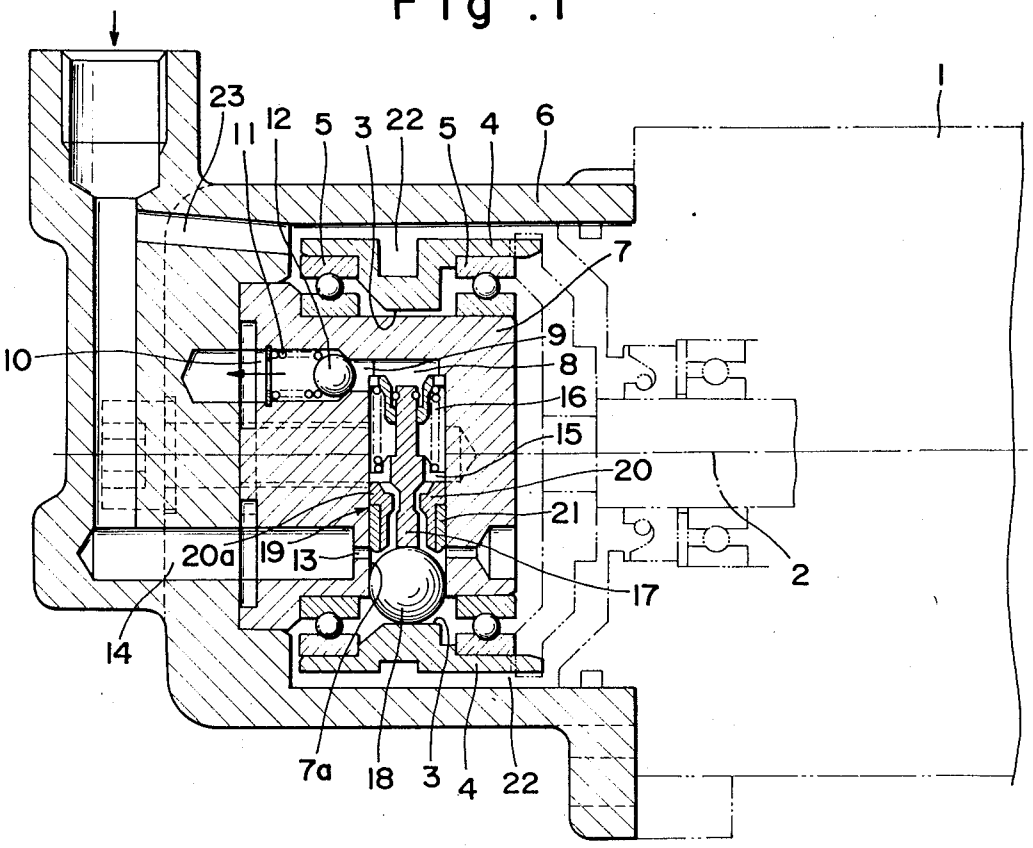
FIG. 1 is a cross-sectional side view showing one example of the invention.

In a first embodiment shown in FIG. 1, a cylindrical cam (4) which is rotatable fixedly with the axis of rotation (2) of motor (1) and on the inner diametral surface of which a cam face (3) is formed and a cylinder body (7) which is positioned inside said cyindrical cam (4) and which is united with a motor case (6) via a bearing (5) are provided. In said cylinder body (7), a cylinder chamber (8) opening at one end in the direction perpendicular to the axis of rotation (2) and closing at the other end is formed. An ejection port (9) is provided through the lateral force on the side of closed end of said cylinder chamber (8), an ejection passage (10) communicating said the ejection port (9) to an accumulator not shown is formed in the cylinder body (7), and further an ejection valve to press a vomit ball (12) against vomit port (9) by means of an ejection spring (11) is provided in said passage (10).

On the other had, through the lateral face on the side of opened end of the cylinder body (7), a suction port (13) is provided, which communicates to reservoir not shown through a suction passage (14).

Moreover, in the cylinder body (7), a suction spring (16), one end of which is fixed on the side of closed end of the cylinder body and the other end of which is contacted with a sring bearing plate (15) provided on the side of opended end of the cylinder body, is provided. A suction rod (17) is extended unitedly from said spring bearing plate (15) toward the side of opened end of the cyinder and, by allowing the tip thereof to slide on the cam face (3) of said cylindrical cam (4), it is contacted with a ball (18) reciprocating in the cylinder body (7). Further, between said ball (18) and said spring bearing plate (15), a cylindrical piston 19), the outer circumferential face of which moves slidably in the cylinder body (7) and which surrounds the suction rod (17), is provided. Said piston (19) has a length that a slight clearance can be formed between said piston (19) and said ball (18) when the tip of suction rod (17) is contacted with the ball (18), and one end face of the piston (19) is formed into a concave surface and still it is formed a approximately same curvature as that of the surface of ball (18) so as the leakage of fluid not to occur when the piston (19) is contacted closely with the ball (18). Further, said piston (19) consists of a resinous inner piston (20) in a portion in close contact with the ball (18) and a steel outer piston (21) in a portion of slidable movement, i.e. in the outer circumferential portion. Moreover, one end of said resinous inner piston (20) has a seal portion (20*a*) to be contacted closely with the inner wall (7*a*).

Moreover, said suction port (13) is formed at a position such that it always lies within a range interposed between the contacting portion of the ball (18) with the inner wall (7*a*) of cylinder and the slidably moving face of the cylindrical piston (19) on the inner wall (7*a*) of cylinder, however deep the ball (18) may extend into the cylinder body (7) by means of the cylindrical cam (4).

With such hydraulic pump, by allowing the motor (1) to start, the cylindrical cam (4) rotates, the ball (18) reciprocates in the cylinder body (7), the ball (18) is contacted closely with the inner piston (20) to close the cylinder chamber (8) when it moves toward the closed end of the cylinder body (7), and the valve is opened due to the pressure inside the cylinder chamber (8), which is raised by pushing the ball (18) further into the cylinder body (7), to eject the oil. After the ball (18) has been pushed to its deepest position, it assumes a free state without being subjected to the force from the cylindrical cam (4) and thus the suction spring (16) slightly returns the ball (18) to a position so as to form a slight clearance between the cylindrical piston (19) and the ball (18). Successively, the suction spring (16) pushes back the cylindrical piston (19) simultaneously with the ball (18) so as to keep said clearane constant via the spring bearing plate (15) and thus the oil flows into the cylinder chamber (8) from the suction portion (13) through said clearance. With the pump as this stage of operation, the seal is not sufficient to prevent leakage and the oil tends to leak into the cam chamber (22) because a contacting portion of the ball (18) contacts with the inner wall (7*a*) of the cylinder is in a point. Hence, the suction passage (14) and the cam chamber (22) are connected through a communicating hole or passage (23) to fill up positively the oil in the cam chamber (22).

Figure 2:
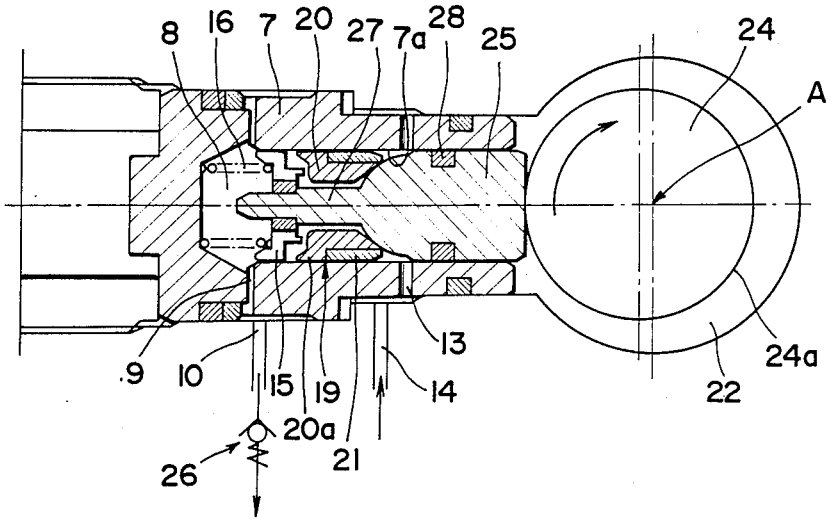
FIG. 2 is a cross section in side view showing another example of the invention, and FIGS. 3(A) and (B) and FIG. (4) are cross sectional side views showing conventional examples.
Figure 3A:
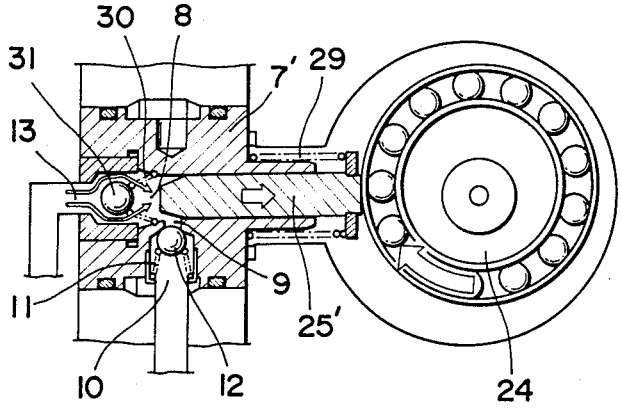
Fig. 3(A) PRIOR ART
Figure 3B:
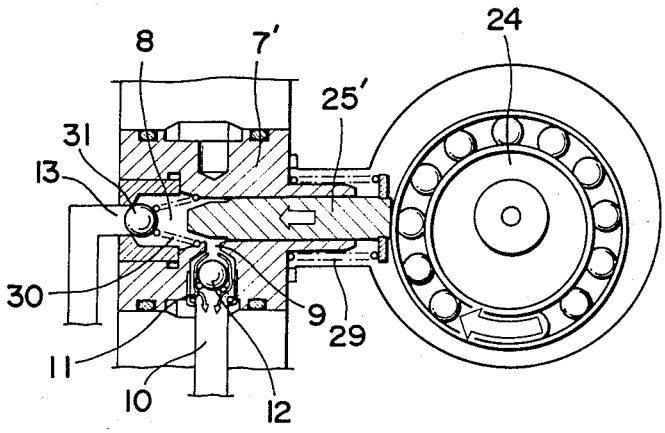
Figure 4:
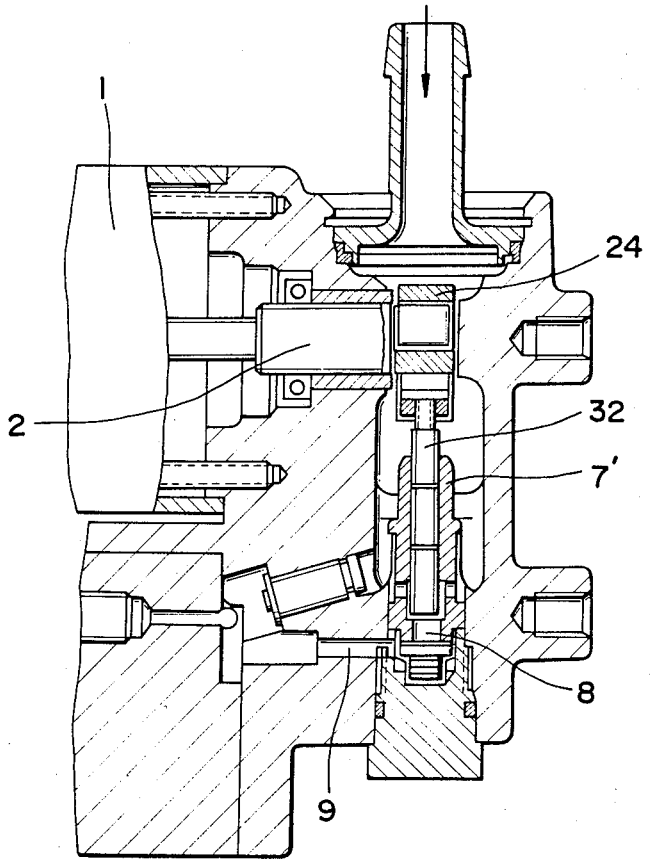
Fig. 4 PRIOR ART

In a second embodiment shown in FIG. 2, one end of a plunger (25) on the side of cylinder chamber (8), which reciprocates in a cylinder body (7) contacted with the outer circumferential face (24*a*) of an eccentric cam (24) rotatable about the axis of rotation of motor not shown in the diagram, is formed in a spherical surface, and the cylinder chamber (8) is closed tightly by the spherical surface contacted closely with a concave surface formed at one end of a resinous inner piston (20) inside a cylindrical piston (19) slidable in the cylinder body (7) when the plunger (25) is pushed into the cylinder chamber (8). Thus, when the plunger (25) is further pushed into the cylinder chamber (8), the oil in the cylinder chamber (8) is ejected from a port (9) to transmit the pressure to an accumulator not shown in the through a check valve (26) provided in a passage (10). Moreover, a rod (27) extends from the plunger (25) passing through the inner diametral hole of cylindrical piston (19), which is contacted with a spring bearing plate (15) located between said piston (19) and the closed end of cylinder body (7) and being pressed from the closed end of cylinder body (7) toward the side said piston (19) by means of a suction spring (16). Then, when the eccentric can (24) rotates in the direction of the arrow around the center of rotation (A) from the state shown in FIG. 2, the plunger (25) is pushed back due to the bounce impact force of the suction spring (16) to separate the closely contacting portion of the spherical surface of plunger (25) with the inner piston (20) so as to a clearance. Successively, the spring bearing plate (15) and the plunger (25) are pushed back together and, at the same time, the spring bearing plate (15) is contacted with the cylindrical piston (19) to be pushed back so as to keep said clearance until the eccentric cam (24) rotates by 180°. At this time, because said clearance communicates to the suction port (13) connecting to a reservoir not shown, which is the supplying source of oil, supplementary oil flows into the cylinder chamber (8).

With such pump, the oil in the cylinder chamber (8) does not leak into the cam chamber (22) thus easy maintenance and repair as compared with the pump in the first embodiment, because a seal packing (28) is provided on the outer circumferential face of the plunger (25).

As described above, the most conspicuous feature of the pumps of the invention is that the cylindrical piston, the spring bearing plate and the plunger are respectively independent.

Thus, at the time of ejection, first the spring bearing plate is pushed and secondly the cylindrical piston is pushed so as to contact closely with the plunger, through the movement of plunger resulting in the fact that the fluid in the cylinder chambers does not return to the side of suction port and opens the valve. On the other hand, at the time of the suction, first the coil spring pushes back the plunger against which the pushing force has been released via the spring bearing plate to separate the closely contacting portion of the cylindrical piston with the plunger and to provide a slight clearance resulting in the communication of the cylinder chamber to the side of suction port, and secondly the plunger is pushed back by means of the coil spring keeping the relative position of the cylindrical piston to the plunger resulting in the flowing of fluid into the cylinder chamber. Namely, the cylindrical piston, the spring bearing plate and the plunger function as a suction valve permitting a simple structure.

Besides, with regards to the shape of plunger, its close contact with one end face of the cylindrical piston can be improved by forming the side of said cylindrical piston with a convex or spherical surface, which is effective for the preventiof fluid leakage etc.

As described, in accordance with the invention, the suction check valve is unnecessary because the mechanism of suction valve can be provided by the pump itself and thus it is possible to manufacture a small-sized inexpensive hydraulic pump. For this reason and others, the invention permits a remarkable effect industrially.

Obviously, numerous modifications and variations of the present invention are possible in light of the above teachings. It is therefore to be understood that within the scope of the appended claims, the invention may be practiced otherwise than as specifically described herein.

What is claimed is:

1. A hydraulic pump, which comprises:
a motor;
a cylinder body having a cylinder member;
a suction portion through which an external fluid is introduced into said cylinder chamber and an ejection port through which said fluid in said cylinder chamber is ejected outward;
a cam member rotatable about an axis of rotation of said motor;
a movable member reciprocably mounted in said cylinder body and engageable with said cam member, wherein said fluid in said cylinder chamber is ejected through said ejection portion when said movable member is moved into said cylinder chamber by said cam member;
a cylindrical piston slidably fitted in said cylinder chamber of said cylinder body wherein said movable member is engageable with said cylindrical piston when said movable member is moved into said cylinder chamber to shut off communication between said cylinder chamber and said suction port, thereby sealing said cylinder chamber; and
a valve provided in said ejection passage for communication with said ejection port wherein said valve is open due to pressure in said cylinder chamber occurring when said movable member is further moved into said cylinder chamber for ejecting said fluid in said hydraulic chamber wherein said cylindrical piston comprises an inner piston and an outer piston and wherein said inner piston is engageable with said movable member.

2. The hydraulic pump according to claim 1, wherein said inner piston comprises a resinous inner piston and said outer piston comprises a steel outer piston.

3. The hydraulic pump according to claim 1, wherein an end face of said cylindrical piston for engaging with said movable member and a face of said movable member for engaging with said cylindrical piston are formed with a concave and spherical surface, respectively, and which have complimentary curvatures.

4. The hydraulic pump according to claim 1, wherein said movable member has a rod extending through the inner side of said cylindrical piston said said spring presses said movable member against the cam face of said cam member via the spring bearing plate contacted with said rod.

5. The hydraulic pump according to claim 1, wherein said cam member comprises an eccentric cam and wherein said movable member is contacted with the outer circumference thereof.

6. A hydraulic pump, which comprises:
a motor;
a cylinder body having a cylinder member;
a suction portion through which an external fluid is introduced into said cylinder chamber and an ejection port through which said fluid in said cylinder chamber is ejected outward;
a cam member rotatable about an axis of rotation of said motor;
a movable member reciprocably mounted in said cylinder body and engageable with said cam member, wherein said fluid in said cylinder chamber is ejected through said ejection port when said movable member is moved into said cylinder chamber by said cam member;
a cylindrical piston slidably fitted in said cylinder chamber of said cylinder body wherein said movable member is engageable with said cylindrical piston when said movable member is moved into said cylinder chamber to shut off communication between said cylinder chamber and said suction port, thereby sealing said cylinder chamber; and
a valve provided in said ejection passage for communication with said ejection port wherein said valve is open due to pressure in said cylinder chamber occurring when said movable member is further moved into said cylinder chamber for ejecting said fluid in said hydraulic chamber wherein said movable member comprises a ball.

7. A hydraulic pump, which comprises:
a motor;
a cylinder body having a cylinder member;
a suction port through which an external fluid is introduced into said cylinder chamber and an ejection port through which said fluid in said cylinder chamber is ejected outward;
a cam member rotatable about an axis of rotation of said motor;
a movable member reciprocably mounted in said cylinder body and engageable with said cam member, wherein said fluid in said cylinder chamber is ejected through said ejection port when said movable member is moved into said cylinder chamber by said cam member;
a cylindrical piston slidably fitted in said cylinder chamber of said cylinder body wherein said movable member is engageable with said cylindrical piston when said movable member is moved into said cylinder chamber to shut off communication between said cylinder chamber and said suction port, thereby sealing said cylinder chamber;
a valve provided in said ejection passage for communication with said ejection port wherein said valve is open due to pressure in said cylinder chamber occurring when said movable member is further moved into said cylinder chamber for ejecting said fluid in said hydraulic chamber to eject fluid in said hydraulic fluid, and
a spring mounted in said cylindrical chamber for biasing said movable member against said cam face of said cam member.

8. A hydraulic pump, which comprises:
a motor;
a cylinder body having a cylinder member;
a suction port through which an external fluid is introduced into said cylinder chamber and an ejection port through which said fluid in said cylinder chamber is ejected outward;

a cam member rotatable about an axis of rotation of said motor;

a movable member reciprocably mounted in said cylinder body and engageable with said cam member, wherein said fluid in said cylinder chamber is ejected through said ejection port when said movable member is moved into said cylinder chamber by said cam member;

a cylindrical piston slidably fitted in said cylinder chamber of said cylinder body wherein said movable member is engageable with said cylindrical piston when said movable member is moved into said cylinder chamber to shut off communication between said cylinder chamber and said suction port, thereby sealing said cylinder chamber;

a valve provided in said passage for communication with said ejection port wherein said valve is open due to pressure in said cylinder chamber occurring when said movable member is further moved into said cylinder chamber for ejecting said fluid in said hydraulic chamber;

a spring for pressing said movable member against a cam face of said cam member;

a spring bearing plate; and a rod connected with said spring bearing plate and contacted with said movable member.

* * * * *